United States Patent [19]

Borg

[11] 4,261,485

[45] Apr. 14, 1981

[54] AUTOMATIC BOTTLE CAP HAVING A MAGNETICALLY ACTUATED VALVE

[76] Inventor: Raymond Borg, 2596 Lakeshore Blvd., W., Toronto, Ontario, Canada, M8V 1J4

[21] Appl. No.: 99,995

[22] Filed: Dec. 4, 1979

[51] Int. Cl.[3] ..... B65D 25/40

[52] U.S. Cl. ..... 222/500; 137/38; 222/504; 222/509; 222/561; 222/563; 251/65

[58] Field of Search ..... 222/500, 504, 509, 523, 222/525, 561, 563; 251/65; 137/38

[56] References Cited

U.S. PATENT DOCUMENTS

| | | | |
|---|---|---|---|
| 2,156,518 | 5/1939 | Titus | 222/509 |
| 2,581,897 | 1/1952 | Allen | 222/81 |
| 2,672,257 | 3/1954 | Simmonds | 220/230 |
| 4,011,969 | 3/1977 | Martin | 222/504 X |

FOREIGN PATENT DOCUMENTS

| | | | |
|---|---|---|---|
| 2021237 | 11/1979 | United Kingdom | 251/65 |

*Primary Examiner*—Robert J. Spar
*Assistant Examiner*—Fred A. Silverberg

[57] ABSTRACT

The specification of the present invention discloses an automatic bottle cap that may be applied to an opened receptacle. The valve used in this cap automatically opens when the receptacle is tipped for pouring and closes when the receptacle returns to the upright position. The device uses two permanent magnets positioned such that a net unbalanced force exists between them which is used to open or close the valve. The movement of one magnet within the structure causes the direction of the net unbalanced force to be reversed causing the second magnet and associated valve stem to move and open or close the valve.

12 Claims, 6 Drawing Figures

AUTOMATIC BOTTLE CAP HAVING A MAGNETICALLY ACTUATED VALVE

FIELD OF THE INVENTION

The present invention relates to automatic closing devices and in particular, to magnetically operated valves for use with receptacles such as beverage bottles.

BACKGROUND OF THE INVENTION

Various valve structures have been proposed for use with bottles and cans and other receptacles, with the structure having a valve member that is adapted to open as a receptacle is tipped for pouring and closed when the receptacle is returned to the upright position. One such structure is shown in U.S. Pat. No. 2,581,897 which discloses a valve assembly having a valve head which moves under the influence of gravity to open and close a receptacle. When the valve is maintained in the upright position the valve head maintains a seal with the valve seat due to the weight of the valve head and upon tipping of the valve the head becomes unseated and the contents of the container may be poured. Although this structure is automatic in that the user does not have to activate the valve separately, it has some inherent drawbacks in that the valve must always be maintained in the upright position for sealing and in that the valve relies on the weight on the valve head for providing a seal. Furthermore, any build up of pressure within the receptacle will reduce the force maintaining the seal and may result in leakage of gas from the receptacle.

A magnetic closing device is shown in U.S. Pat. No. 2,672,257 but, the device is not automatic in that the user must manually open the valve prior to tipping of the receptacle. The reference does disclose how a magnetic base portion may be used with a cap made from a magnetic attractable material, such that upon closing of the cap the seal is maintained by the magnetic attraction between the base magnet and the cap material.

The present invention provides a fully automatic valve closing device which is opened when the receptacle is tipped for pouring and closed when the receptacle is returned to the initial position, while overcoming the problems associated with the gravity operated system disclosed in U.S. Pat. No. 2,581,897.

SUMMARY OF THE INVENTION

The present invention is a value closing device for use with receptacles and particular beverage bottles comprising an active magnet, a passive magnet and a valve closing mechanism. All magnets are of the permanent type with the active magnet slideably secured in the structure and adapted to move relative to the passive magnet under the influence of gravity. The passive magnet forms part of the valve closing mechanism and is orientated such that a net unbalanced force exists between said magnets. The arrangement is such that tipping of the valve for pouring of the contents of a receptacle causes the active magnet to move relative to the passive magnet, changing the direction of the net unbalanced force between the magnets and urging the passive magnet to move in essentially the opposite direction to the active magnet and thereby, open the valve closing mechanism. The valve is closed by returning the valve to the upright position, causing the active magnet to move relative to the passive magnet reversing the direction of the net unbalanced force between the magnets causing movement of the passive magnet in the opposite direction to the active magnet thereby closing the valve. The valve structure further includes a stop means for determining the distance through which the magnets move and to assure the active magnet can move relative to the passive magnet upon returning the valve to the upright position.

The arrangement utilizes the net unbalanced force which exists between the magnets for maintaining the valve in the open or closed position wherein the active magnet may move relative to the passive magnet reversing the direction of the net unbalanced force between the magnets causing the passive magnet to move and open or close the valve.

The active magnet must be sized such that upon tipping of the receptacle for pouring the gravitational force exerted on the active magnet is greater then the net unbalanced force between the magnets, thereby allowing the active magnet to move relative to the passive magnet. The active magnet must move through a sufficient distance to cause the direction of the net unbalanced force to be reversed, thereby urging the passive magnet to move in the opposite direction to the active magnet. The net unbalanced force between the magnets must be sufficient such that the gravitational force exerted on the passive magnet is less than the force between the active and passive magnets thus assuring the passive magnet moves to the open position upon tipping of the valve. Furthermore, the movement of the passive magnet must be limited to allow the active magnet to move relative to the passive magnet upon returning the receptacle to the upright position.

BRIEF DESCRIPTION OF THE DRAWINGS

The preferred embodiments of the invention are shown in the drawings wherein.

DETAILED DESCRIPTION OF THE PREFERRED EMBODIMENTS

Figure 1:
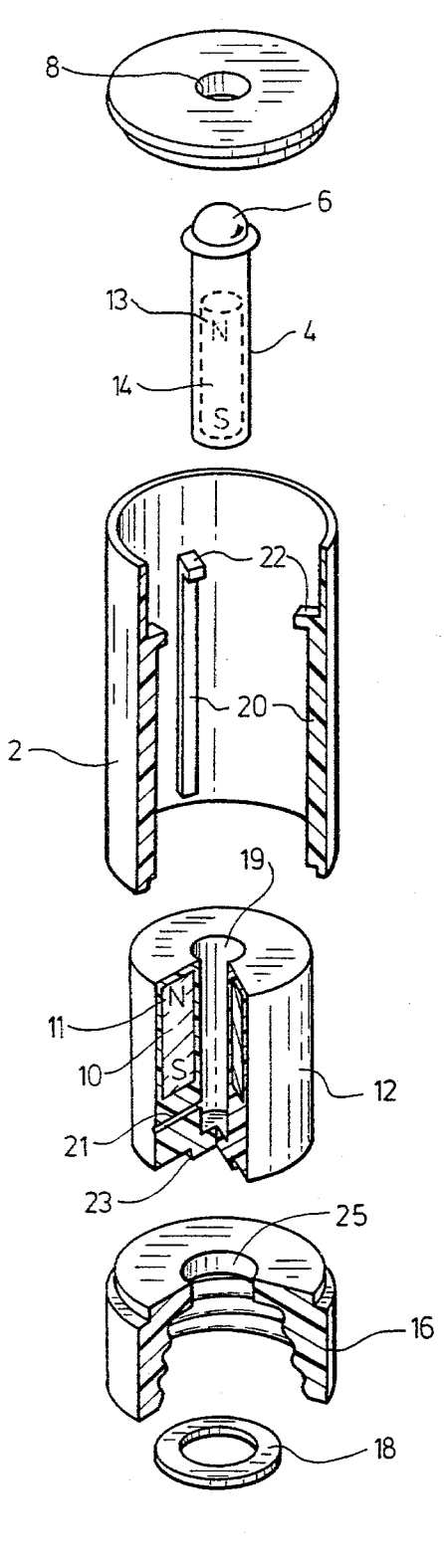
FIG. 1 is an exploded view of the device adapted for use with a threaded beverage bottle.

An exploded view of a valve closing device according to the present invention is shown in FIG. 1 comprising a valve body 2, a valve stem 4, a valve head 6, a valve seat 8, an active magnet 10 embedded in a circular member 12, a passive magnet 14 secured within the valve stem 4, a valve base 16 and washer 18. The valve body 2 contains slide rails 20 for determining and guiding the movement of the active magnet 10, within the valve body. The device is adapted to to threadably engaged neck of a bottle due to the threaded base portion 16. The active magnet and associated circular member 12 move from the upper surface of the base portion to the stop portions 22 provided on slide rails 20.

Thus, the active magnet 10 moves relative to the passive magnet 14 when the valve is tipped for pouring causing the resultant force on the valve stem to be downward and away from the valve seat 8. During the initial movement of the active magnet the repulsive forces between the magnets increases, however the passive magnet can not move due to the valve head 6 engaging valve seat 8. However, after pole 11 has moved past the like north pole 13 of the passive magnet the direction of the repulsive force acting on the passive magnet is reversed causing valve stem 4 to move to the open position. The movement of the valve stem 4 and the passive magnet 14 is limited. Thus, the movement of the active magnet under the influence of gravity causes the force exerted on the stem member to be reversed in direction forcing the stem member to move away from the seat. The resultant force on the stem member 4 is essentially the net repulsive force between the active and the passive magnets and the structure limits the movement of the magnets such that a net repulsive force is present between the magnets. The movement of the valve stem 4 away from the valve seat causes the valve to be open and allows the contents of the bottle to be poured. Upon returning the bottle to the upright position, the active magnet slides back to its original position supported on base portion 16. This movement causes the force between the active magnet and the passive magnet to be reversed, thus urging the valve stem member to the closed position. These aspects can be more fully appreciated by reviewing FIGS. 2 and 3.

Figure 2:
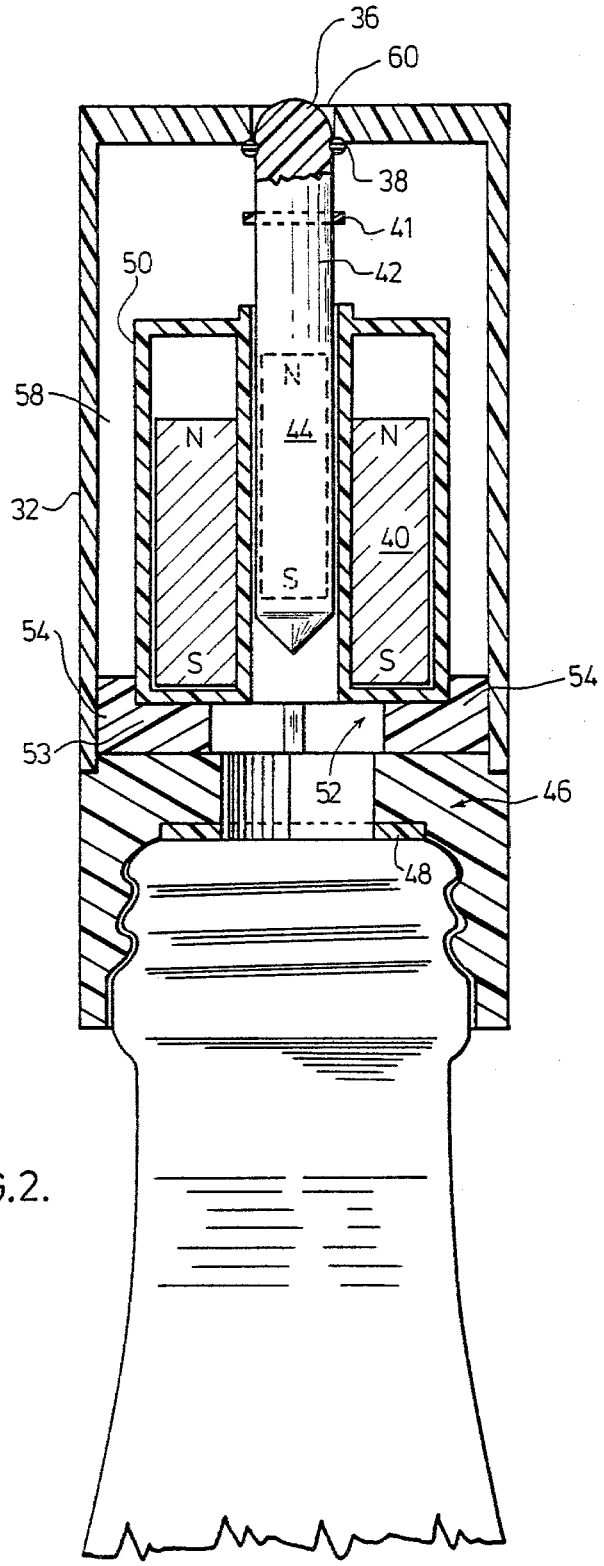
FIG. 2 is a vertical section taken through the valve closing device according to the present invention adapted for use with a threaded beverage bottle.
Figure 3:
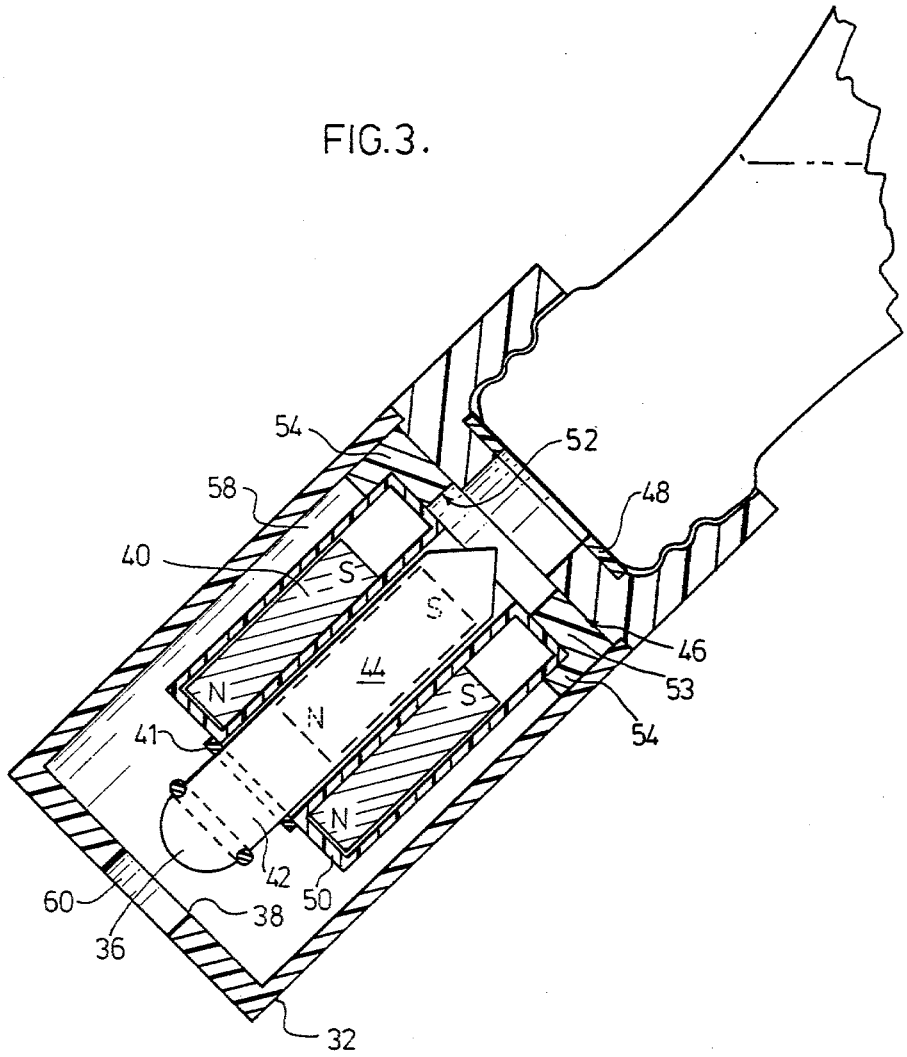
FIG. 3 illustrates the valve closing device shown in FIG. 2 when tipped for pouring.

Turning to FIGS. 2 and 3 a slightly different structure is shown however, the principles are the same. According to this embodiment, the valve closing device comprises a valve casing 32 a valve stem member 42, a valve head 36, a valve seat 38, a passive magnet 44, an active magnet 40, a base member 46 for threadably engaging a bottle, and a washer member 48. The base member 46 is of a step construction to define a passage 52 and a surface 54 for snuggly receiving the lower portion of the case member 50. The surface 54 is on a projecting portion 53 of the base member 46 with several of these projecting portions being located about the upper surface of the base member. Thus, when the bottle is tipped the casing 50 is maintained in its position relative to the base, and the contents of the bottle may pass through passages 52 and outer channel 58 and eventually through the outlet orifice 60. When the bottle is tipped for pouring as shown in FIG. 3 the active magnet slides to the lower end of the casing 50, causing the poles of the active magnet to be below adjacent like poles of the passive magnet. This change in position establishes a net repulsive force acting on the valve stem 42 urging the plunger to move in the opposite direction to the movement of the active magnet, thereby opening the valve and allowing the contents of the bottle to be discharged. The flange 41 which is part of the valve stem 42 bottoms out against casing 50 and this determines the extent of downward movement of the valve stem. Upon returning the bottle to the upright position, the active magnet returns to the position shown in FIG. 2 causing the poles of the active magnet to locate below corresponding poles of the passive magnet resulting in a net force on the valve stem urging the valve head to seal with the valve seat.

Returning to FIG. 1, it can be seen that the active magnet 10 is embedded in the circular member 12 and the member 12 must move within the valve body to allow the active magnet to move relative to the passive magnet. When the device is assembled the valve stem 4 is placed within the cylinder 19 of member 12 and any fluid which may seep into the cylinder and below valve stem 4 may be discharged through port 21 when the valve is tipped for pouring.

A further feature of the structure of FIG. 1 is that two seals are provided, one being between the valve seat 8 and the valve head 6 which is maintained due to the net repulsive force between the magnets and the second seal being between the lower surface of the circular member and the base portion 16. To accomplish this second seal, a circular raised portion 23 is provided on the lower surface of circular member 12 and is received within the orifice 25 when the valve is returned to the upright position. This second seal is essentially maintained by the weight of the circular member 12 and the inter fit between member 23 and orifice 25. This particular arrangement provides better sealing due to two sealing locations and also maintains the product being dispensed within the valve when the same is returned to the vertical position. This may be advantageous when the product being dispensed is a soft drink as the surfaces between valve stem 4 and the cylinder 19 will not be allowed to dry reducing the tendency for these surfaces to adhere to one another. However, it should be noted that this is only a preferred aspect of the invention and is not essential to the operation of a valve.

With the structures shown in FIGS. 1 and 2, the active magnet has been circular with an internal bore for the passive magnet, and valve stem. With this arrangement the repulsive force between the active magnet and the passive magnet tends to self center the valve stem with the bore of the active magnet such that the walls of the valve stem 4 and the internal walls of the circular member 12 or the casing 50 are spaced thereby reducing the tendency for the valve stem to adhere to these surfaces. This self centering action can also be accomplished by using several magnets to form the active magnet and spacing these magnets about the passive magnet.

Figure 4:
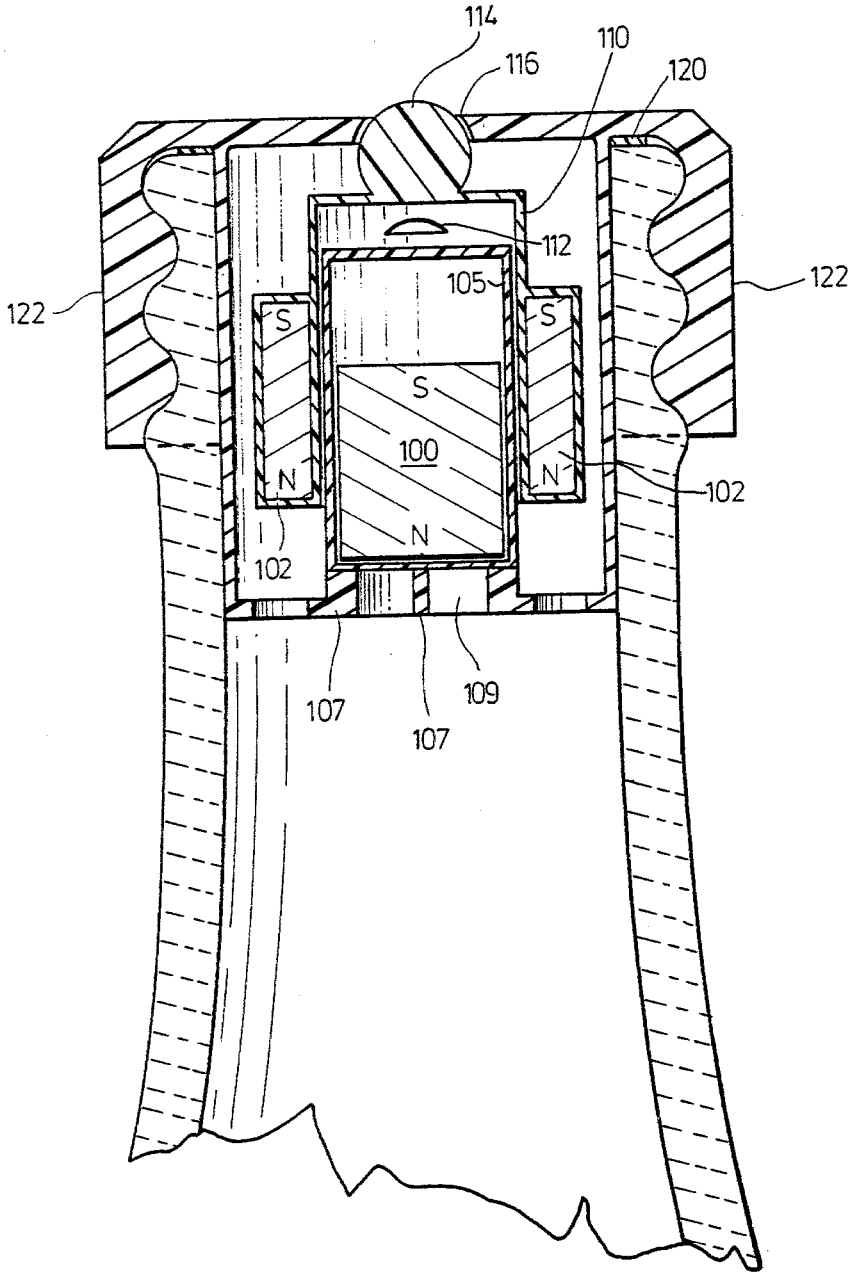
FIG. 4 shows a vertical section through a valve closing device having an alternate construction.

The structure shown in FIG. 4 is more compact as the internal workings of the valve are designed to be placed within the neck of a bottle. Furthermore with this structure the active magnet 100 is located interior to the passive magnet 102 with the active magnet being housed in a fixed casing 105. The casing 105 seals the active magnet from the contents of the receptacle and is of sufficient length to allow the active magnet to move relative to the passive magnet and reverse the direction of the net repulsive force acting on the magnet. Although the position of the magnet has been reversed this is not essential for this modification and it is shown to clearly indicate that the active magnet need not be exterior to the passive magnet.

As in the structure of FIG. 2, the casing 105 is secured within the valve by projections 107 spaced about the base of the valve and defining apertures 109 between the projections for allowing the contents of the bottle to be dispensed.

The passive magnet in this case is tubular in shape or may be made up of several arc shaped magnets positioned about the active magnet. The valve stem 110 is also tubular and adapted to sleeve casing 105. Drain vent holes 112 have been provided in the upper portion of the tubular member 110 to allow any product which is trapped between the tubular member 110 and the upper surface of the casing 105 to be dispensed to the exterior of the tubular casing. An arc shaped valve head 114 has been provided at the top of valve stem 110 and may be made of a suitable resilient material such that the valve head and orifice 116, provided in the outer casing of the valve, effect a seal. If the valve head 114 is not made of a resilient material, but it may be necessary to provide a suitable gasket about the valve seat of orifice 116.

A resilient gasket 120 has been provided at the upper surface of the neck of the beverage bottle and provides a seal between the outer casing 122 of the valve with this outer casing threadably engaging the neck of the bottle.

Although it is not an essential aspect of the present invention, it may be desirable for the valve head to project slightly beyond the casing of the valve in the closed position when the valve is used with beverage bottles and particularly when the product is carbonated. In this case, the internal pressure of the product exerts a force on the valve head and more firmly seats the valve head against the valve seat. Although this provides for a more effective seal, it provides an additional force which must be overcome for the valve member to move to the open position, and in some cases, this may be of sufficient strength such that the net repulsive forces between the magnet is not sufficient to open the valve. If this is the case, the user may before tipping the receptacle, briefly exert a downward force on the outside of the valve head and release the internal pressure. Upon subsequent tipping of the receptacle, the valve will open as previously described.

With all the structures previously described, the valve is normally placed in the upright position and subsequently moved through an angle greater than 180° to allow the contents of the receptacle to be poured. After a sufficient quantity of the product has been dispensed the valve is returned to the upright position and the active magnet slides under the influence of gravity thereby urging the passive magnet to effect sealing of the valve. If the receptacle is placed horizontally the active magnet will not move and therefore the seal is still maintained. This will be particularly advantageous when the user wishes to store receptacles on their sides as the present valve will maintain the seal in the horizontal position or in the vertical position.

Figure 5:
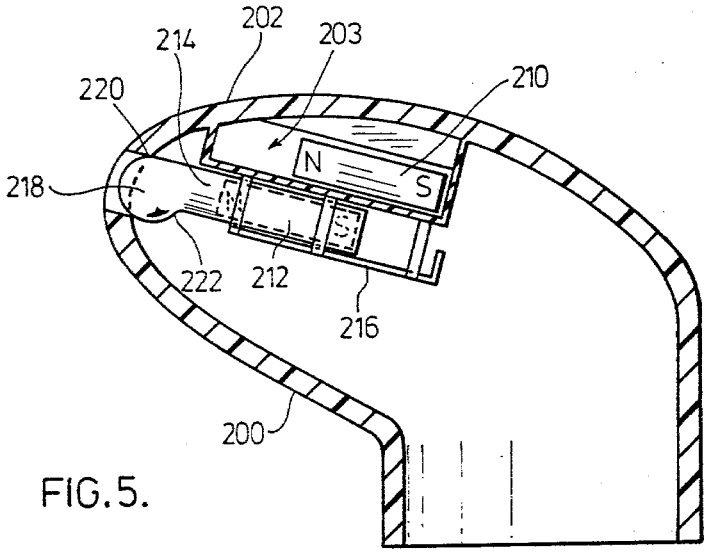
FIG. 5 is a vertical section of a preferred embodiment of the valve closing device which has been adapted for easy pouring of the contents of an associated receptacle.
Figure 6:
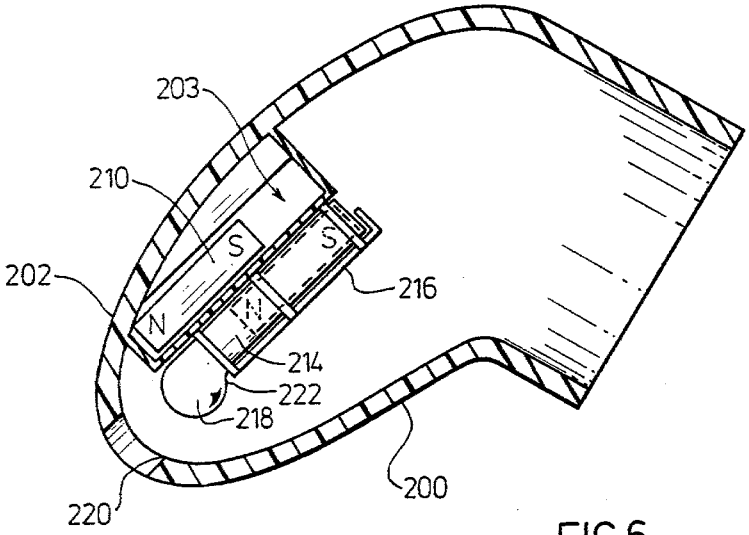
FIG. 6 shows the valve of FIG. 5 tipped pouring.

An altered valve structure is shown in FIGS. 5 and 6 where the axis of valve 200 has been disposed at an angle of approximately 45° from the vertical and the active magnet 210 is located within a pocket 203 of the exterior valve casing 202. The pocket 203 is completely sealed from the contents of the receptacle and thus there is no possibility of product contaminating this area. The permanent magnet 210 co-operates with a passive magnet 212 located within the valve stem 214. A support structure 216 has been provided to maintain the valve stem in close proximity to the active magnet. The valve head 218 forms a seal with orifice 220 and has been provided with an enlarged portion 222 of the valve head for limiting the movement of the passive magnet within the structure. By positioning the axis of the valve at an angle from the vertical the active magnet slides relative to the passive shortly after the valve is passed through an angle of approximately 45° and normally prior to the contents of the receptacle entering the upper portion of the valve. Because of this the valve stem moves more easily as it is not initially exposed to the flow of the product. As the structure is returned to the initial position the product flows back into the receptacle minimizing the tendency for valve stem 214 and the supporting structure 216, to adhere to one another. Furthermore, with this structure there is no need to provide venting ports as shown with the structures of FIGS. 1 and 4.

With all structures, the valve will normally be made of a plastic material which can easily be molded and is non-magnetic so it does not interact with the magnets. It is clear that the majority of the valve, except for the magnets, should be made from nonferrous materials, however, it may be possible for some components to be ferrous if they do not interfere with the interaction and movement of the magnets.

The length of the magnets will vary with the application and design parameters, however, it is preferred that the magnets be of approximately equal length or with the passive magnet slightly longer in length.

The structures previously described have been designed such that the poles of the magnets are orientated in the same direction. This is the preferred structure, however, it is possible for the poles of the magnets to be orientated in the opposite direction. If this is the case, in the closed position the centre of the passive magnet is displaced slightly downwardly from the centre of the active magnet such that a net upward force is exerted on the valve stem. Upon tipping of the valve the active magnet moves relative to the passive magnet such that a net repulsive force having a direction opposite to the movement of the active magnet is exerted on the valve stem to open the valve.

The valve closing device according to the present invention uses an active magnet which is slideably secured within the housing and interacts with a passive magnet such that a net unbalanced force exits between the magnets. The movement of the active magnet upon tipping of the valve causes the poles of the magnets to change position relative to each other and reverse the direction of the force on the passive magnet. This reversal in the direction of the force causes the valve to be opened thereby allowing the product to be dispensed. Upon returning the valve to the upright position, the active magnet again moves under the influence of gravity relative to the passive magnet, reversing the direction of the force between the magnets causing said passive magnet to move and close the valve.

Thus the present valve when secured to a receptacle automatically opens upon tipping of the receptacle and closes when the receptacle is returned to the upright position. Furthermore, the device according to one embodiment may be placed in the horizontal position for storage while still maintaining a seal. The present valve provides the convenience of an open receptacle while maintaining the advantages of properly sealing the receptacle for storage.

Although various preferred embodiments of the invention have been described herein in detail, it will be appreciated by one skilled in the art that variations may be made thereto without departing from the spirit of the invention or the scope of the appended claims.

The embodiments of the invention in which an exclusive property or privilege is claimed are defined as follows:

1. An automatic valve for use with receptacles and particularly beverage bottles comprising an active magnet, a passive magnet, and a valve closing mechanism, said active permanent magnet slidably secured in said valve and adapted to move relative to said passive magnet under the influence of gravity, said passive magnet forming part of the valve closing mechanism and orientated such that a net unbalanced force exists between said magnets, the arrangement being such that tipping of said valve for pouring the contents of a receptacle causes said active magnet to move relative to said passive magnet thereby changing the direction of the net unbalanced force between said magnets urging said passive magnet to move in essentially the opposite direction to said active magnet and thereby open said valve closing mechanism, said valve being closed by returning the valve to the upright position causing said active magnet to move relative to said passive magnet changing the direction of the unbalanced force between said magnets and causing said passive magnet to move in the opposite direction and close the valve, said valve further including a stop means for determining the distance through which said magnets move.

2. An automatic valve for use with receptacles and particularly beverage bottles comprising an active magnet, a passive magnet, and a valve closing mechanism, said active permanent magnet slidably secured in said valve and adapted to move relative to said passive magnet under the influence of gravity, said passive magnet forming part of the valve closing mechanism and orientated such that like poles of said magnets are adjacent establishing a net repulsive force between said magnets, the arrangement being such that tipping of said valve for pouring the contents of a receptacle causes said active magnet to move relative to said passive magnet thereby changing the repulsive force between said magnets urging said passive magnet to move in essentially the opposite direction to said active magnet and thereby open said valve closing mechanism, said valve being closed by returning the valve to the upright position causing said active magnet to move relative to said passive magnet changing the direction of the repulsive force between said magnets causing said passive magnet to move in the opposite direction and close the valve said valve further including a stop means for determining the distance through which said magnets move.

3. A valve as claimed in claim 2 wherein said valve closing member includes a valve stem and a valve head, said passive magnet being embedded and sealed in said valve stem and said valve head co-operates with a valve seat for closing said valve.

4. A valve as claimed in claim 2 wherein the axis of said magnets are aligned.

5. A valve as claimed in claim 2, 3 or 4, wherein said active magnet sleeves said passive magnet such that the repulsive force between said magnets centers said passive magnet within the sleeve.

6. A valve as claimed in claims 2, 3 or 4, wherein said passive magnet affects closing of the outlet orifice of said valve and said active magnet is embedded in circular non-magnetic casing such that said casing forms a second seal at the inlet surface when the valve is closed.

7. A valve as claimed in claim 4, wherein said active and passive magnets are essentially equal in length.

8. A valve as claimed in claim 4 wherein said active magnet is smaller than said passive magnet.

9. A valve as claimed in claim 4, wherein said active magnet comprises a number of magnets arranged about said passive magnet.

10. A valve as claimed in claim 4, further including a threaded base portion for engaging the neck of a beverage bottle, said valve including an inlet and outlet orifice with the axis of the outlet orifice at an angle of approximately 45° to the axis of said inlet orifice, the axis of said active and passive magnets also being angled similar to the axis of said outlet orifice thereby providing fast opening of said valve upon tipping of said receptacle for pouring.

11. A valve as claimed in claim 4 wherein said valve head partially projects from said valve allowing manual release of pressure within said valve and/or said receptacle.

12. An automatic valve for use particularly with beverage bottles comprising a valve body adapted to sealingly engage the neck of a bottle adjacent the inlet orifice for said valve, an outlet orifice and valve seat generally opposite said inlet orifice, a valve head and stem for co-operating with said valve set to open and close said valve, an active permanent magnet slidably secured in said valve, a passive permanent magnet forming part of said valve stem, the arrangement being such that said magnets in all operating positions have like magnetic poles essentially adjacent each other thereby establishing a net repulsive force between magnets for maintaining the valve head and stem in either the closed or open position, wherein the tipping of the bottle for pouring causes said active magnet to slide within said valve under the influence of gravity relative to said passive magnet, a sufficient distance to establish a net repulsive force on said passive magnet in the opposite direction to the initial force on said passive magnet thereby opening said valve, the arrangement further including a stop means for determining distance through which the valve head and stem moves and to allow said active magnet to move relative to said passive magnet upon return of the valve to the generally upright position to thereby reverse the direction of force on said passive magnet and cause said valve head and stem to move and close said valve.

* * * * *